US006563464B2

(12) United States Patent
Ballantine et al.

(10) Patent No.: US 6,563,464 B2
(45) Date of Patent: May 13, 2003

(54) INTEGRATED ON-CHIP HALF-WAVE DIPOLE ANTENNA STRUCTURE

(75) Inventors: Arne W. Ballantine, Round Lake, NY (US); Jennifer L. Lund, Amawalk, NY (US); Anthony K. Stamper, Williston, VT (US)

(73) Assignee: International Business Machines Corporation, Armonk, NY (US)

( * ) Notice: Subject to any disclaimer, the term of this patent is extended or adjusted under 35 U.S.C. 154(b) by 73 days.

(21) Appl. No.: 09/811,940

(22) Filed: Mar. 19, 2001

(65) Prior Publication Data

US 2002/0145566 A1 Oct. 10, 2002

(51) Int. Cl.[7] ..... H01Q 1/38

(52) U.S. Cl. ..... 343/700 MS; 343/795; 257/531; 257/778

(58) Field of Search ..... 343/700 MS, 754, 343/795, 853; 257/725, 728, 777, 778, 673, 531; 455/90, 314

(56) References Cited

U.S. PATENT DOCUMENTS 5,185,613 A * 2/1993 Whatmore et al. ..... 343/909
5,367,308 A 11/1994 Weber
5,396,658 A 3/1995 Hwu et al.
5,404,581 A 4/1995 Honjo
5,541,614 A 7/1996 Lam et al.
5,621,913 A 4/1997 Tuttle et al.
5,629,241 A * 5/1997 Matloubian et al. ..... 438/125
5,757,074 A * 5/1998 Matloubian et al. ..... 257/702
5,786,626 A 7/1998 Brady et al.
5,903,239 A * 5/1999 Takahashi et al. ... 343/700 MS

* cited by examiner

*Primary Examiner*—Tho Phan
(74) *Attorney, Agent, or Firm*—Schmeiser, Olsen & Watts; Mark F. Chadurjian

(57) ABSTRACT

A semiconductor device is presented which is composed of two adjacent semiconductor chips. Each semiconductor chip has an integrated half-wave dipole antenna structure located thereon. The semiconductor chips are oriented so that the half-wave dipole antenna segments extend away from each other, allowing the segments to be effectively mated and thus form a complete full-wave dipole antenna. The two solder bumps which form the antenna are separated by a gap of approximately 200 microns. The length of each solder bump antenna is based on the wavelength and the medium of collection. Phased array antenna arrays may also be constructed from a plurality of these semiconductor chip antennae.

16 Claims, 2 Drawing Sheets

INTEGRATED ON-CHIP HALF-WAVE DIPOLE ANTENNA STRUCTURE

BACKGROUND OF THE INVENTION

1. Technical Field

The present invention relates generally to the field of formation of semiconductor devices having inductive and capacitive elements, and more specifically to a method for fabricating a half-wave dipole antenna structure using known semiconductor processing techniques.

2. Related Art

Semiconductor chips are continually being made smaller with the goals of increasing both device speed and circuit density. Miniaturized devices built within and upon a semiconductor substrate are spaced very closely together, and their packaging density continues to increase. As the packaging density increases, semiconductor chips are subject to electrical and physical limitations which stem from the reduced size of the areas available for their placement. Also, as products utilizing advanced electronics become more complex, they rely on larger numbers of semiconductor chips for their intended operation.

Underlying the complex nature of much sophisticated equipment is the need for communication between various semiconductor chips. As the space between chips available for signal conductor routing shrinks, the area available for communications conductors becomes increasingly limited while at the same time communications needs increase. One solution to this need for increased communications incorporates radio frequency signals for communicating within and between semiconductor chips.

At present, semiconductor chips commonly contain integrated circuits which operate at clock frequencies near the gigahertz ("GHz", i.e., $10^9$ Hertz) frequency range. These integrated circuits effectively utilize on-chip wiring techniques for communication between active and passive circuit elements.

However, in future integrated circuits, these clock frequencies are expected to extend high into the GHz range. At such frequencies, on-chip wiring techniques exhibit inductive, resistive and capacitive delays which may significantly impair circuit performance.

Therefore there is a need for alternative passive devices which can effectively improve the speed of electrical signal propagation through active and passive components. One such type of passive device is the type of antenna used in radio frequency ("RF") communication. This kind of RF communication system can be adapted for use at the semiconductor chip level by utilizing antennae which are fabricated on the semiconductor chips themselves. For instance, at 15 GHz, the free space wavelength of an electromagnetic ("EM") wave is approximately 2 cm. In a silicon chip, the permittivity can be as high as 12, with a resulting wavelength of approximately 6 mm. This translates into a ¼-wavelength antenna that is only 1.5 mm long. This antenna dimension is much smaller than projected semiconductor chip dimensions. Therefore, integration of antennae with the required receiver and transmitter circuits may become feasible, at frequencies in the GHz range, for intra- and inter-chip wireless communication. See, for example, "Characteristics of Integrated Dipole Antennas on Bulk, SOI, SOS Substrates for Wireless Communication", Kihong Kim and Kenneth K. O, IITC 98-21, IEEE, 1998.

SUMMARY OF THE INVENTION

The invention disclosed herein presents an on-chip antenna apparatus that enables radio frequency (RF) communication between integrated circuits. A method for forming the antenna is also disclosed.

The present invention provides an antenna formed on a semiconductor structure, said semiconductor structure comprising: a substrate, containing electrical circuits operationally related to the functionality of the antenna; a first antenna element and a second antenna element formed on said substrate, wherein said first and second antenna elements each have a longitudinal axis and each of said longitudinal axes lies along substantially the same linear axis, and are separated by a gap; wherein each of said first and second antenna elements are in electrical contact with said electrical circuits; and wherein each of said first and second antenna elements are composed of solder bumps.

The present invention also provides a method of forming an antenna structure on a semiconductor substrate comprising the steps of: providing a semiconductor substrate; providing semiconductor devices fabricated within at least one layer of said semiconductor substrate; forming at least one solder bump antenna element on the semiconductor substrate; and forming at least one connecting device to electrically connect said solder bump antenna element and at least one of said semiconductor devices.

The present invention additionally provides a method of forming a phased antenna array of semiconductor chip antennae comprising: providing a plurality of semiconductor substrates; forming a plurality of on-chip solder bump antennae on said semiconductor substrates; and manipulating said plurality of on-chip solder bump antennae.

The present invention further provides a semiconductor packaging structure comprising: a semiconductor chip having an antenna formed on a first surface thereof; a plurality of electrical interconnects formed on the first surface; and a device for connecting to said semiconductor chip via said electrical interconnects, said device having structural refinements to operationally accommodate said antenna.

The foregoing and other features and advantages of the invention will be apparent from the following more particular description of the preferred embodiments of the invention.

DETAILED DESCRIPTION OF THE INVENTION

The present invention discloses an integrated half-wave dipole antenna structure having one half-wave dipole antenna element on one surface of a first chip, and a second half-wave dipole antenna element on the surface of a second adjacent chip. A dipole antenna is formed by the combination of the two half-wave dipole antennae elements. The two dipole antenna elements are oriented such that they extend away from each other, in the manner of mirror images. Moreover, the gap separating these two mirror images is determined by the desired operating wavelength, for example, the gap can be approximately 200 microns for an operating frequency of 10 GHz.

Figure 1:
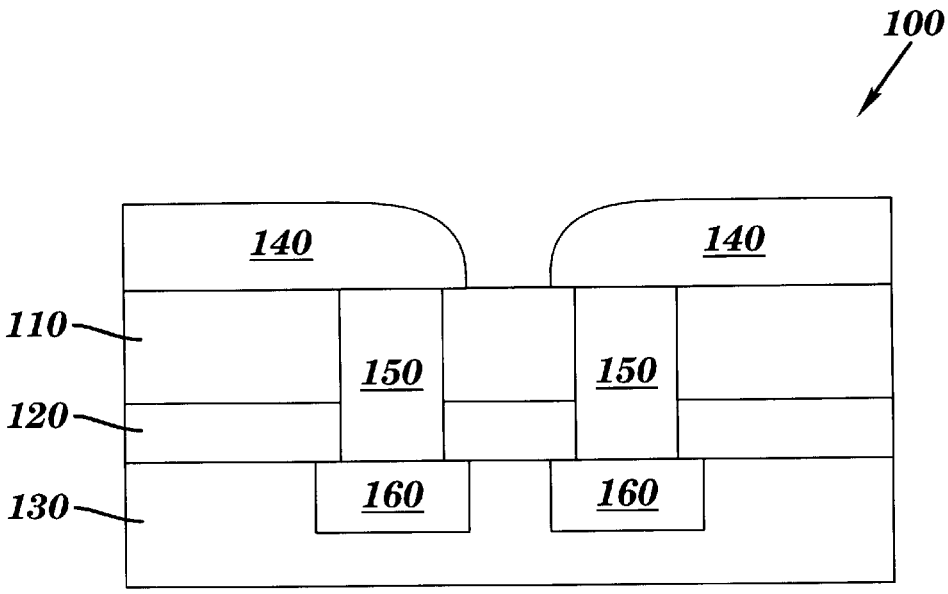
FIG. 1 is a cross-section view of a portion of a semiconductor structure showing two antenna leads of a half-wave dipole antenna.

Referring to FIG. 1, an apparatus according to the present invention is shown in cross-section. This view shows a portion of a semiconductor structure 100 consisting of a base insulator layer 130, a final passivation layer 120 (such as, inter alia, silicon dioxide) deposited upon the base insulator layer 130, and a protective resin (e.g., polyimide) layer 110, about 5–10 micron thick, deposited upon the final passivation layer 120 (such as, inter alia, a layer, about 0.5 micron thick, of silicon dioxide capped with a layer, about 0.5 micron thick, of silicon nitride).

The base insulator layer is a substrate composed of material selected from the following materials, inter alia, bulk crystalline silicon, silicon-on-insulator, silicon-on-sapphire, gallium arsenide, indium phosphide, or arsenides, phosphides, antimonides, and nitrides of group III and group V transition elements. The base insulator layer 130 contains one or more interconnecting metal layers, the uppermost or last metal ("LM") of which 160 is electrically connected to a terminal-via ("TV") 150. Each terminal-via ("TV") 150 extends through the intermediate final passivation layer 120 and the polyimide layer 110. Two antenna wires 140 are formed as elongated solder bumps upon the polyimide layer 110. Each of the two antenna wires 140 is connected to one of the terminal-vias 150. The semiconductor structure 100 may additionally contain other active or passive electrical elements (e.g., transistors, diodes, resistors, and the like).

Figure 2:
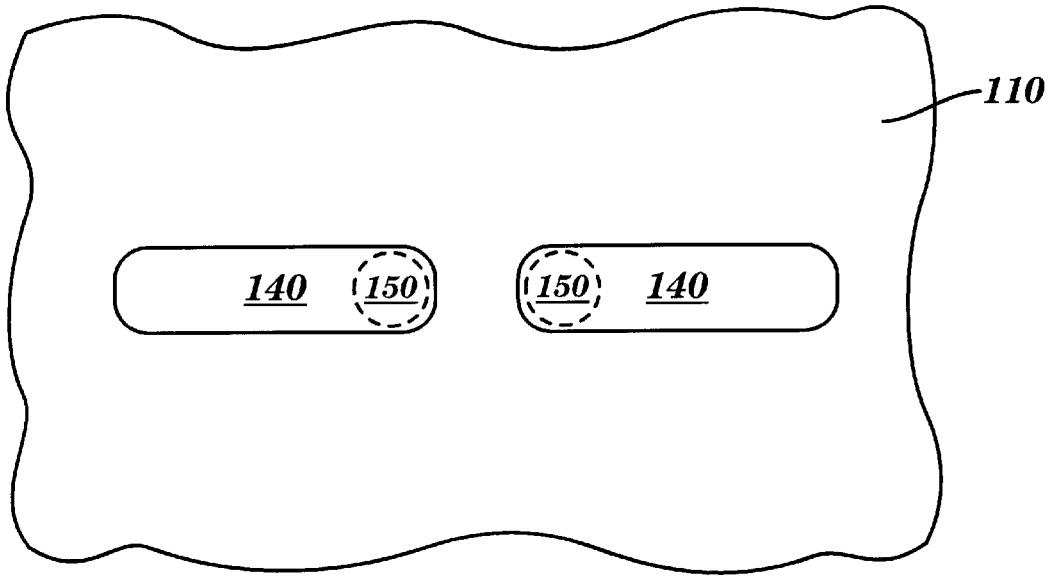
FIG. 2 is a plan view of two C4 antenna wires contacting to LM the last metal ("LM") interconnect level.

Referring now to FIG. 2, a plan view of the apparatus according to the present invention is illustrated. The polyimide layer 110 constitutes the uppermost, planar surface of the semiconductor structure 100. The through-vias 150 which connect the antenna wires 140 to the LM 160 are shown in phantom. The antenna wires 140 are schematic representations only, since their length can be adjusted to the desired tuning frequency of the antenna.

The length of each antenna wire 140 is determined based upon a value of one-half of the wavelength in the medium of collection. For example, for a frequency of 30 GHz in air, the total wire length would be 5 mm or 2½ mm for each dipole. Similarly, for a frequency of 50 GHz in air, the total wire length would be 3 mm or 1½ mm for each half-wave dipole. See, for example, a typical textbook on microwave electronics, such as that by Ghandi, et al.

Comparing the currents of the solder bump antenna to the wire antenna, $I_D(C4)/I_D(Wire)=(39)/(7\times10^{-4})=6\times10^4$. A solder bump antenna has about $6\times10^4$ more current carrying capability as compared to a wire antenna on chip, which leads to an increase in the effective broadcast range by a factor of about 100. The data in Table 1 illustrates the advantages in maximum radiation distance that a solder bump antenna 300 of the present invention can achieve as compared to a conventional wire antenna.

TABLE 1

| | Maximum Distance | |
|---|---|---|
| S:N | Wire Antenna mm | Solder Bump Antenna mm |
| 100 | 12 cm | 28 m |
| 20 | 26 cm | 61 m |

In Table 1, S:N represents the signal to noise ratio. Assuming a given wire dimension, the maximum distance, in any direction from the antenna, at which the given signal to noise ratio can be achieved is as shown in Table 1. The Wire Antenna has dimensions of 0.5 micron height and 0.5 micron width. The Solder Bump Antenna has dimensions of 120 micron length and 120 micron width.

In an alternative embodiment of the invention, a plurality of semiconductor chip antennae of the present invention are arranged to form an array. Such an array could be of one or two dimensions. A one-dimensional, or linear array, can form the beam only in one direction, e.g., only in azimuth, and has a fixed pattern in elevation. A two-dimensional array can shape the beam in any direction, azimuth as well as elevation, thus providing an antenna which is tunable to provide steerable transmission beams.

Figure 3:
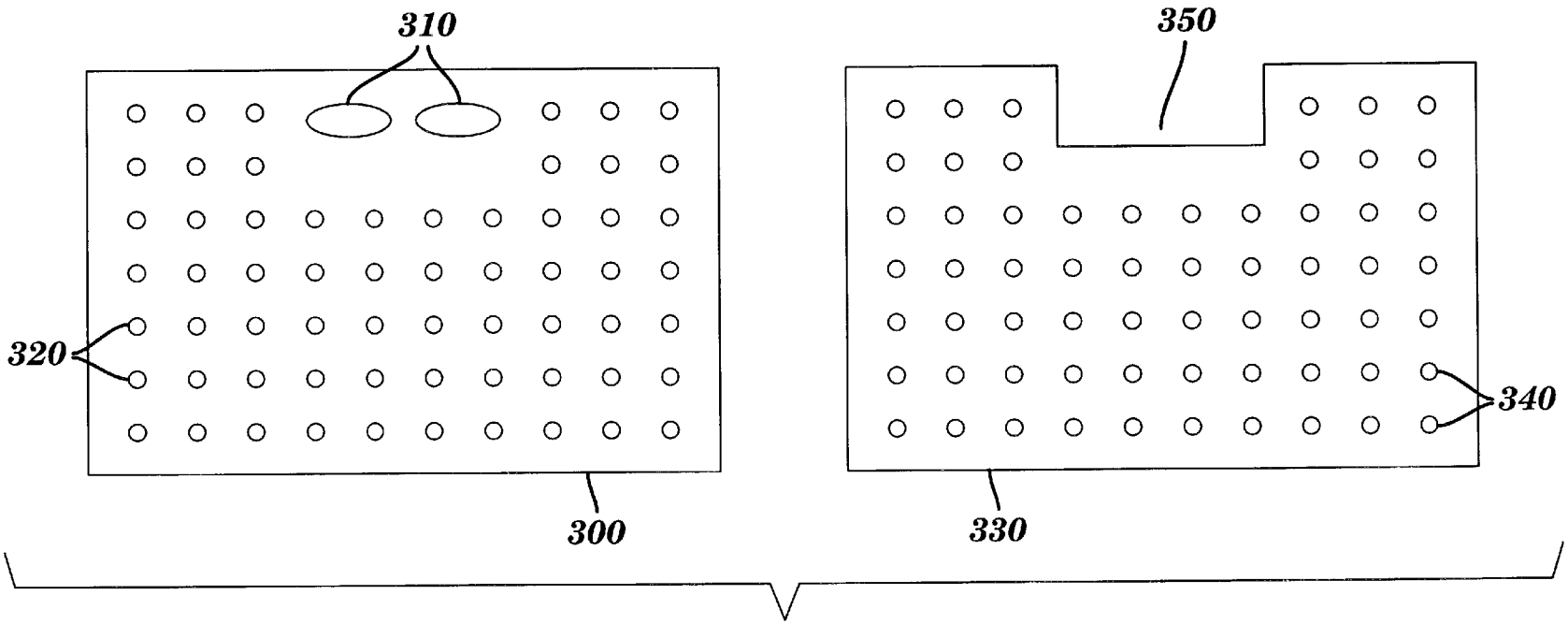
FIG. 3 is a plan view of two components comprising a flip-chip semiconductor packaging structure.

Referring now to FIG. 3, a plan view of two components 300, 330 comprising a flip-chip semiconductor packaging structure is shown. A surface of semiconductor chip 300 is shown to contain half-wave dipole antenna elements 310 and a plurality of electrical connections 320, such as, inter alia, solder bumps. The mating chip 330 has a plurality of bonding pads 340 which are arranged to correspond to the plurality of electrical connections 320. Mating chip 330 is further characterized by an area 350 which corresponds to half-wave dipole antenna elements 310, enabling half-wave dipole antenna elements 310 to operate when the two components 300, 330 are assembled to each other.

While embodiments of the present invention have been described herein for purposes of illustration, many modifications and changes, such as alternative antenna designs, will become apparent to those skilled in the art. Accordingly, the appended claims are intended to encompass all such modifications and changes as fall within the true spirit and scope of this invention.

What is claimed is:

1. An antenna formed on a semiconductor structure, said semiconductor structure comprising:

a substrate, containing electrical circuits operationally related to the functionality of the antenna;

a first antenna element and a second antenna element formed on said substrate, wherein said first and second antenna elements each have a longitudinal axis and each of said longitudinal axes lies along substantially the same linear axis, and are separated by a gap;

wherein each of said first and second antenna elements are in electrical contact with said electrical circuits; and wherein each of said first and second antenna elements are solder bumps.

2. The antenna of claim 1, wherein the electrical circuits in electrical contact with said antenna form an RF signal transmitter current source.

3. The antenna of claim 1, wherein the electrical circuits in electrical contact with said antenna form an RF signal detector.

4. The antenna of claim 1, wherein the electrical circuits and the first and second antenna elements are electrically connected by at least one through via.

5. The antenna of claim 1, wherein said first and second antenna elements have a thickness of approximately 120 microns and a length of approximately 120 microns.

6. The antenna of claim 1, wherein said gap separating said first and second antenna elements is about 200 microns.

7. An antenna formed on a semiconductor structure, said semiconductor structure comprising:

a substrate, containing electrical circuits operationally related to the functionality of the antenna, wherein the substrate is selected from a group consisting of bulk crystalline silicon, silicon-on-insulator, silicon-on-sapphire, gallium arsenide, indium phosphide, or arsenides, phosphides, antimonides, and nitrides of group III and group V transition elements;

a first antenna element and a second antenna element formed on said substrate, wherein said first and second antenna elements each have a longitudinal axis and each of said longitudinal axes lies along substantially the same linear axis, and are separated by a gap;

wherein each of said first and second antenna elements are in electrical contact with said electrical circuits; and wherein each of said first and second antenna elements are solder bumps.

8. A method of forming an antenna structure on a semiconductor substrate comprising the steps of:

providing a semiconductor substrate;

providing semiconductor devices fabricated within at least one layer of said semiconductor substrate;

forming at least one solder bump antenna element on the semiconductor substrate; and forming at least one connecting device to electrically connect said solder bump antenna element and at least one of said semiconductor devices.

9. The method of claim 8, wherein the connecting device is a through-via.

10. The method of claim 8, wherein the semiconductor devices include an RF signal transmitter.

11. The method of claim 8, wherein the semiconductor devices include an RF signal receiver.

12. A method of forming a phased antenna array of semiconductor chip antennae comprising:

providing a plurality of semiconductor substrates;

forming a plurality of on-chip solder bump antennae on said semiconductor substrates; and manipulating said plurality of on-chip solder bump antennae.

13. The method of forming a phased antenna array of semiconductor chip antennae of claim 12, wherein the antennae are half-wave dipole antennae.

14. The method of forming a phased antenna array of semiconductor chip antennae of claim 13, further comprising the steps of:

tuning the antennae to provide steerable transmission beams; and tuning the antennae to provide steerable reception beams.

15. A semiconductor packaging structure comprising:

a semiconductor chip having an antenna formed on a first surface thereof, wherein said antenna is formed from at least one solder bump;

a plurality of electrical interconnects formed on the first surface; and a device for connecting to said semiconductor chip via said electrical interconnects, said device having structural refinements to operationally accommodate said antenna.

16. The semiconductor packaging structure of claim 15, wherein said semiconductor packaging structure is a flip-chip structure.

* * * * *